United States Patent [19]

Crawford

[11] Patent Number: 4,634,210

[45] Date of Patent: Jan. 6, 1987

[54] ELECTRICAL CONNECTORS

[75] Inventor: Gregan F. Crawford, Edinburgh, Scotland

[73] Assignee: Hewlett Packard Company, Palo Alto, Calif.

[21] Appl. No.: 807,099

[22] PCT Filed: Mar. 28, 1985

[86] PCT No.: PCT/GB85/00123

§ 371 Date: Nov. 25, 1985

§ 102(e) Date: Nov. 25, 1985

[87] PCT Pub. No.: WO85/04528

PCT Pub. Date: Oct. 10, 1985

[30] Foreign Application Priority Data

Mar. 28, 1984 [GB] United Kingdom ..... 8407948

[51] Int. Cl.[4] ..... H01R 13/11

[52] U.S. Cl. ..... 339/176 MP; 339/258 P

[58] Field of Search ..... 339/17 L, 176 MP, 176 MF, 339/258 R, 258 P

[56] References Cited

U.S. PATENT DOCUMENTS

| | | | |
|---|---|---|---|
| 4,087,151 | 5/1978 | Robert et al. | 339/176 MP |
| 4,285,565 | 8/1981 | Kirby | 339/176 MP |
| 4,514,030 | 4/1985 | Triner et al. | 339/176 MP |

*Primary Examiner*—Joseph H. McGlynn

*Attorney, Agent, or Firm*—Karl E. Bring

[57] ABSTRACT

A printed circuit board connector is disclosed in which contacts of the connector are self-cleaning as the board is inserted into or extracted from the connector.

8 Claims, 16 Drawing Figures

ELECTRICAL CONNECTORS

This invention is concerned with electrical connectors.

In the telecommunications field, especially in the private sector where telephone circuits are provided for continuous use, there is a requirement for accessing and testing these circuits without interrupting them so that they can remain in service and in use while testing takes place. These private telephone circuits, or lines, are not part of the public dial-up network and therefore require specialised testing equipment as is provided, for example, by the Hewlett-Packard HP37100 series remote access testing system.

It is a primary requirement that the test equipment must be installed in a circuit so that it can be disconnected from or connected into that circuit without breaking transmission in that circuit. To achieve this, the test equipment typically comprises a number of "access cards" which can be connected into the circuit to be tested, each access card having mounted thereon a plurality of relays, the relays operating in a manner such as to maintain continuity of circuit, and to switch the circuit to the test equipment as hereinafter described. Each access card is essentially a printed circuit board having conductive traces thereon leading to and from relays mounted on the board and extending to an edge of the board on both surfaces thereof. The traces thus provide edge connectors along the edge of the board, which edge connectors are arranged to be held in electrically-conductive spring clips which provide normally contacting jaws when the board is not urged therebetween and can be forced apart by the edge of the board when the test equipment is connected in circuit.

FIGS. *3a*, *3b*, and *3c* depict an edge portion of a circuit board in progressive stages of insertion into a prior art spring clip.

FIGS. *4a* and *4b* depict the extremities of leaf-spring portions of a prior art spring clip in exaggerated form as the clip is sprung.

FIGS. *5a* and *5b* depict examples of corrosion build-up between a circuit board and leaf-spring portions of a prior art spring clip while the circuit board is inserted, and corrosion build-up between leaf-spring portions of a prior art spring clip after the circuit board is removed.

Figure 6:
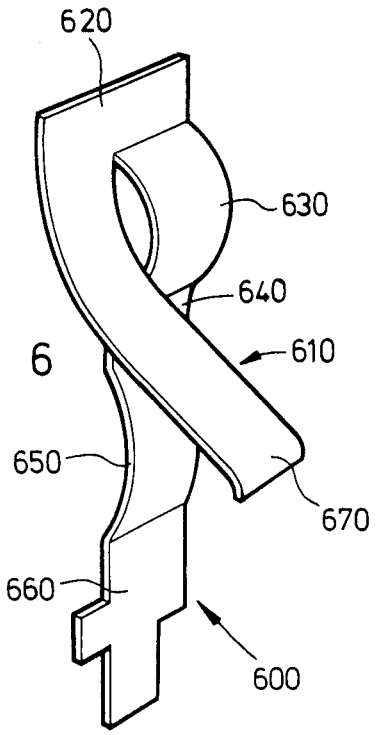

FIG. 6 is a perspective view of an element according to the invention.

Figure 7:
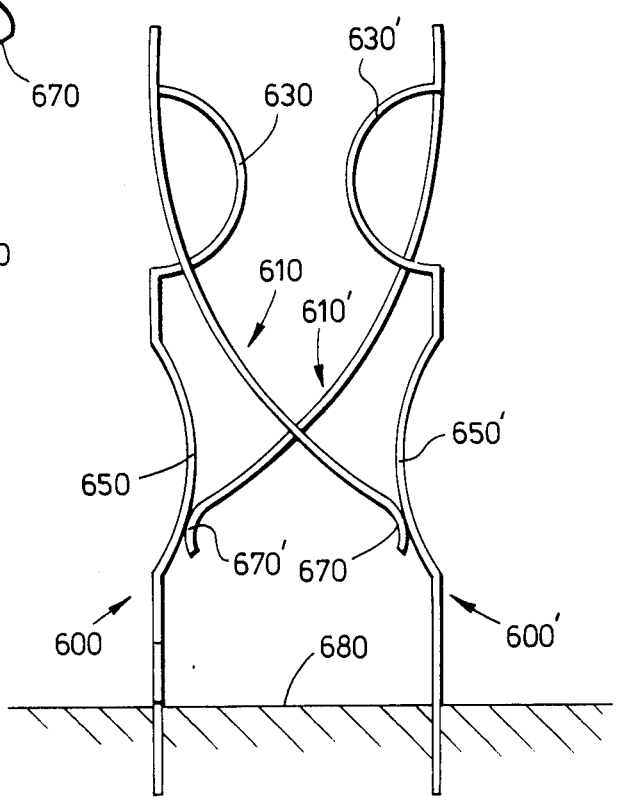

FIG. 7 is a side view of a connector according to the invention in a first, relaxed, condition.

Figure 8:
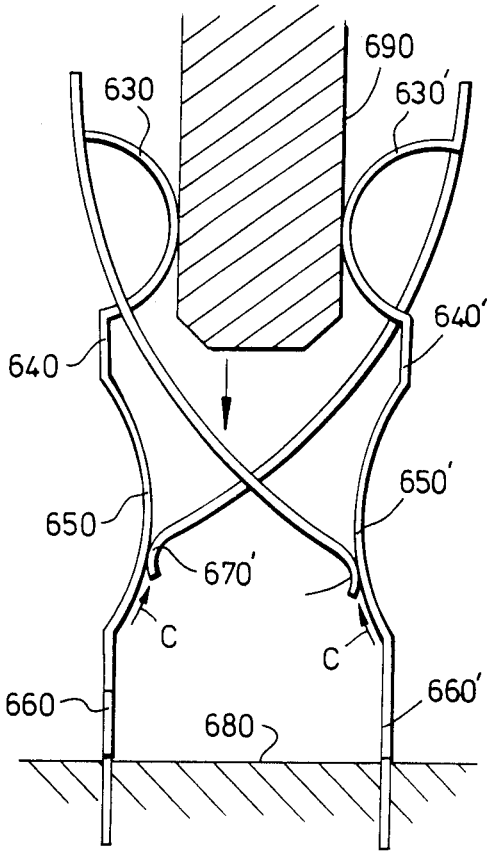

FIG. 8 is a side view of the connector of FIG. 6 partially extended by an edge portion of a printed circuit board.

Figure 9:
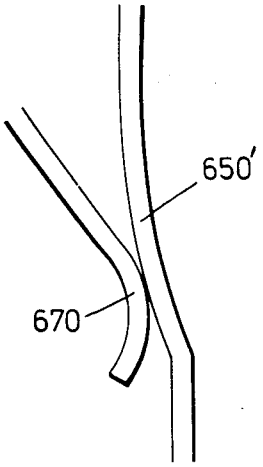
Figure 10:
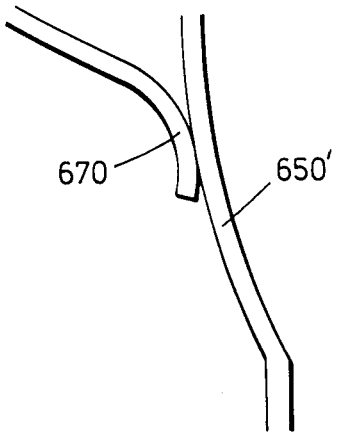

FIGS. 9 and 10 are exaggerated views illustrating a characteristic feature of the present invention.

Figure 11:
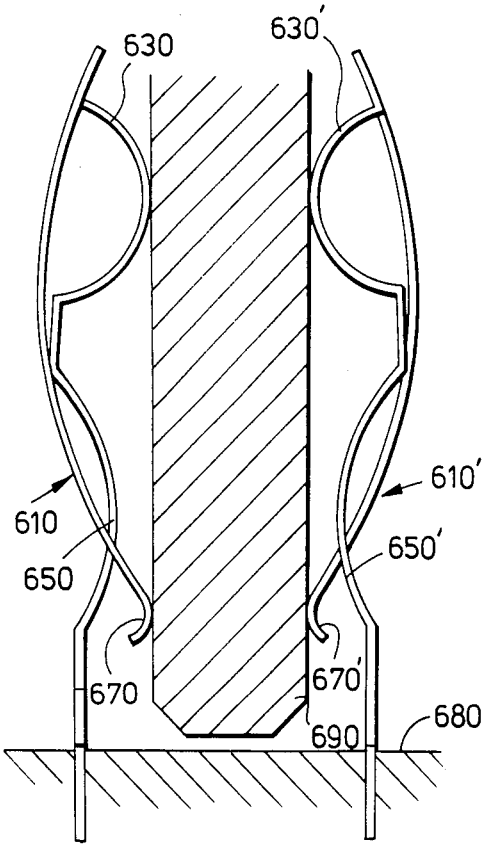

FIG. 11 is a side view, similar to FIG. 8, of the connector, depicting the connector in fully expanded condition with a printed circuit board inserted therein.

Figure 12:
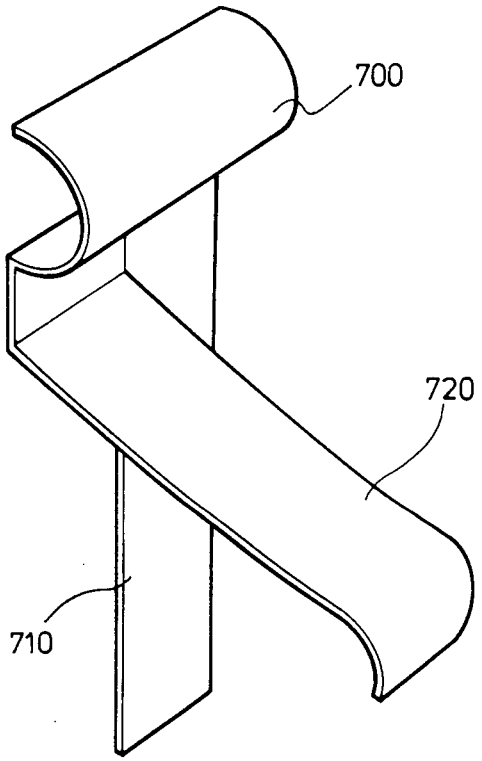

FIG. 12 is a perspective view of a further element according to the invention.

Figure 1:
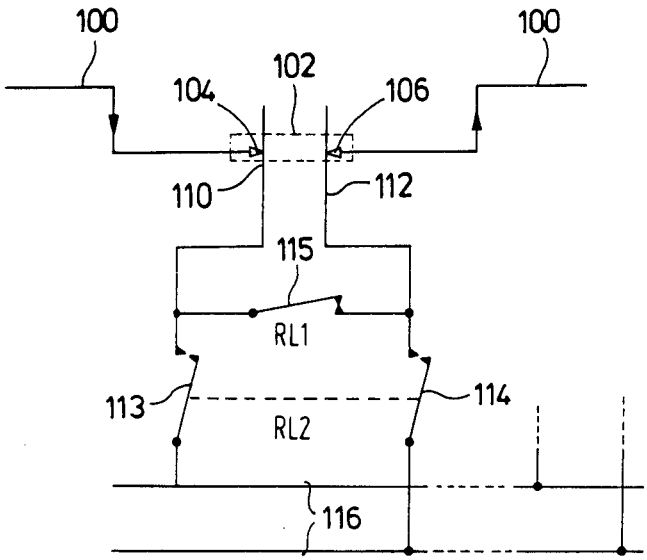
FIG. 1 is a schematic circuit diagram of an access card in a single circuit line.

FIG. 1 is a schematic circuit diagram which illustrates the principle of interconnection of an access card in a single circuit line, of which in practice there are many. The line 100 includes a spring clip indicated by the box 102, the clip comprising jaws indicated by the two arrowheads 104, 106. As illustrated in FIG. 1, the jaws 104, 106 are sprung apart and make contact with edge connectors 110, 112 on opposite surfaces of a circuit board, the connectors being electrically connected to relays RL1, RL2 mounted on the board.

Provided that the jaws 104, 106 make good electrical contact with the connectors 110, 112 continuity is maintained in the line 100 via the closed contact 115 of the relay RL1, while the contacts of the relay RL2 remain open. When it is desired to test the circuit, the contacts of the relay RL2 are closed and those of the relay RL1 are opened to divert the circuit through an access bus 116 to test equipment provided at a remote location. In normal operation, the circuit is maintained through the contact 115 of the relay RL1 and only for occasional intervals is the circuit switched through the relay RL2 to the remote test equipment. Occasionally, a component, e.g. a relay, of an access card can fail and at that point in time it is necessary to withdraw the access card from use. At this point the access card is physically moved so that the edge connectors thereof are withdrawn from between the jaws of the spring clip, the design of the spring clip being such that the jaws make contact with each other before becoming disconnected from the connectors, thereby preserving circuit continuity. However, with current spring clip design, it is possible that dirt can collect on the jaws of the spring clip and prevent closing of the circuit, thereby disrupting flow of information therethrough. This problem will become more clear from reference to FIGS. 2, *3a–3c*, *4a–4c* and *5a*, *5b* which illustrate an element of a typical prior art spring clip and the potential problem that may arise due to ingress of dirt or due to corrosion on the jaws of the clip.

Figure 2:
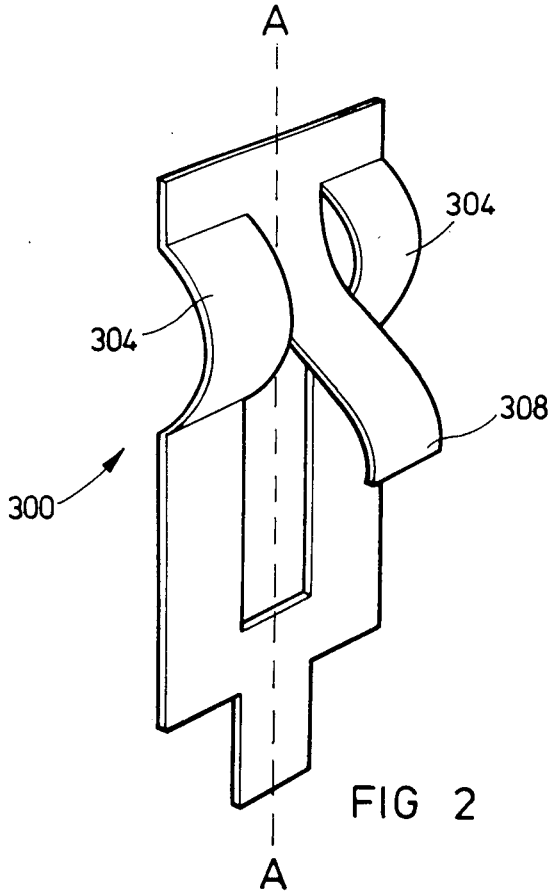
FIG. 2 depicts an element of a prior art spring clip.

The prior art clip comprises two elements 300 such as are shown in FIG. 2, the two elements being mounted in face-to-face relationship, as indicated in side elevation in FIG. *3a*. Each element is made of electrically-conductive material, and the two elements are mounted a distance apart from each other on an insulating base 302 such that the shortest distance between opposed arched portions 304 of the elements is less than the thickness of a printed circuit board 306 to be inserted therebetween, and such that the two leaf-spring portions 308 of the opposed elements are urged against each other adjacent their extremities 310.

As the edge portion of a circuit board is inserted into the spring clip, the elements of the clip flex apart as shown in FIGS. *3b* and *3c*, until the board is located between the elements. Insertion of the board can be considered as a two-stage process, in the first stage of which, as the board is urged between the arched portions 304, continuity of the circuit is maintained through the leaf-spring portions 308 which remain in contact and through the closed contact of relay RL1 of FIG. 1. In the second stage, continuity of circuit is transferred entirely to the contact of relay RL1. The reverse is true when the board is withdrawn from the clip.

It will be seen from FIG. 2 that the geometry of each element is symmetrical about the line A—A and from FIG. *3a* it can also be seen that the geometry of the clip is also symmetrical about the plane B—B normal to the paper. The symmetry of this arrangement can cause a number of different problems, all of which can adversely affect continuity of circuit.

When the printed circuit board is removed, circuit integrity relies on only one contact from each side of the make-before-break connector provided by the clip, i.e., the leaf-spring portion 308 of each connector. This means that if any dirt or detritus, such as glass fibre from the printed circuit board or corrosion products, becomes trapped between the contacts provided by the leaf-spring portions 308, the circuit will not close and will remain open. In a private circuit telephone line, used for transmission of data from one computer installation to another, such an open circuit may remain open until detected with consequent loss of valuable data.

Figure 4A:
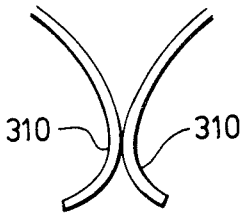
Figure 4B:
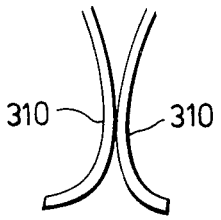

The second problem which can arise with such an arrangement as is provided by the prior art, is that as the clip is sprung, the extremities 310 of the leaf-spring portions 308 will roll against each other, as shown in exaggerated form in FIGS. 4*a* and 4*b*. There will be no self-cleaning between these end portions and particles may even become trapped between them to be ground into the surfaces thereof.

Figure 5A:
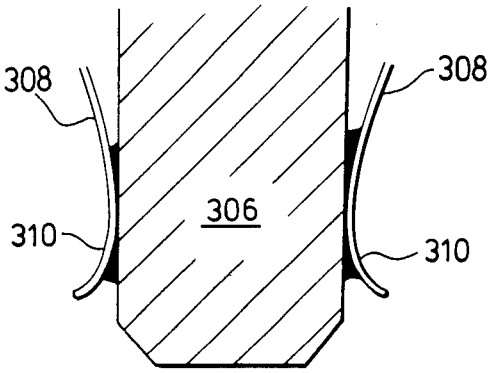
Figure 5B:
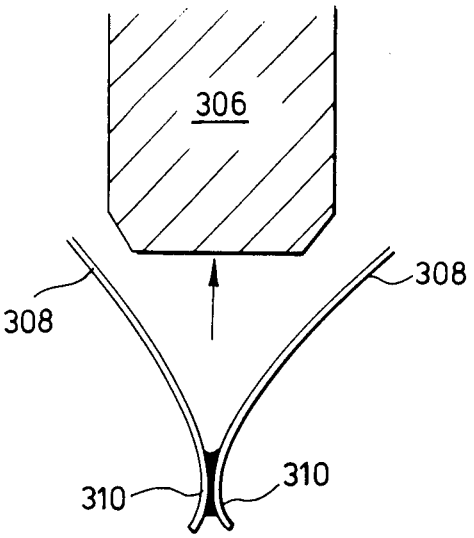

The third problem that can occur is also a result of the environment in which access to a circuit line is available. If a printed circuit board has been mounted in a plurality of clips for a sufficient period of time in an industrial environment, it is very possible that corrosion products may form on the leaf-spring portions 308 or that dirt deposits may build up between the board 306 and the leaf-spring portions. Whilst this may be satisfactory whilst the board is in situ and will not adversely affect the quality of electrical contact, as soon as the board is removed, there may be a tendency for the board to drag the deposits from a position in which they may do no harm onto the face of the actual contact area so that the deposits are exactly where they should not be when the board is removed. Furthermore, corrosion products may build-up at the end of a conductive trace on the board where the material of the trace is exposed. This may lead, on withdrawal of the board, to the corrosion products being dislodged and becoming trapped between the ends of the leaf-spring portions, thus preventing the leaf-spring portions from coming into contact. These effects are shown in FIGS. 5*a* and 5*b*.

The present invention provides an electrically-conductive connector element suitable for use with a like element, when mounted in face-to-face relationship therewith, in providing a connector for electrical connection to a printed circuit board, the element comprising a bridge portion and first and second resiliently-flexible elongate portions in side-by-side relationship and integrally-formed with said bridge portion, the first elongate portion being formed as a leaf-spring to electrically contact the opposed element, and the element further comprising a laterally-extending portion arranged to face the other element so that a printed circuit board can be inserted between the two elements firstly to conductively engage the laterally-extending portions with conductive traces on opposite sides of the circuit board and urge them apart while electrical contact is maintained between the two elements, and so that the circuit board can be further inserted to separate the leaf-springs from electrical contact with the opposed element and to establish electrical contact between the leaf-spring and said conductive traces, the element being characterized in that the second elongate portion thereof comprises a mounting portion, and the leaf-spring is of a length and shape such that as the laterally-extending portions of the two elements of a connector are urged apart or flex together, the end portion of each leaf-spring wipes against surface portions of the opposed element to provide self-cleaning of the contacting surfaces.

In an element as set forth in the last preceding paragraph, it is preferred that the second elongate portion includes said laterally-extending portion, said laterally-extending portion being provided adjacent the bridge portion. Alternatively, the laterally-extending portion may be provided by the bridge portion.

In an element as set forth in either one of the last two immediately preceding paragraphs, it is preferred that the leaf-spring thereof is adapted, when the element is mounted in opposed relationship to a like element, to electrically contact the second elongate portion of the like element, whereby two separate electrical connections are made between the elements.

In an element as set forth in any one of the last three immediately preceding paragraphs, it is preferred that the second elongate portion also comprises a curved portion bowed in the same direction as the laterally-extending portion and provided between the laterally-extending portion and the mounting portion.

In an element as set forth in the last preceding paragraph, it is preferred that the end portion of the leaf-spring is adapted to bear against the curved portion of an opposed element.

The present invention also provides a connector for electrical attachment to a printed circuit board and comprising a pair of electrically-conductive resiliently-flexible elements arranged to be mounted in face-to-face relationship, each element comprising a bridge portion and first and second elongate portions in side-by-side relationship and integrally-formed with said bridge portion, the first elongate portion being formed as a leaf-spring arranged to electrically contact the opposed element, and each element further comprising a laterally-extending portion facing the other element so that a printed circuit board can be inserted between the two elements firstly to conductively engage the laterally-extending portions with conductive traces on opposite sides of the circuit board and urge them apart while electrical contact is maintained between the two elements, and so that the circuit board can be further inserted to separate the leaf-springs from electrical contact with the opposed element and to establish electrical contact between the leaf-springs and conductive traces, the connector being characterized in that each second elongate portion comprises a mounting portion, and each leaf-spring is of a length and shape such that as the laterally-extending portions are urged apart or flex together, the end portion of each leaf-spring wipes against surface portions of the opposed element to provide selfcleaning of the contacting surface.

The present invention also provides means for connecting circuit means to components on a printed circuit board, said means comprising a plurality of connectors as set forth in the last preceding paragraph and arranged in a linear array for receiving and making electrical contact with conductive traces provided along an edge portion of the circuit board and electrically connected with said components.

The present invention further provides a connector for electrical attachment to a circuit board and comprising a pair of opposed, electrically-conductive, resiliently-flexible conductor elements, each element comprising a first portion arranged to make electrical contact with a conductive trace on a respective surface of the board when the board is initially inserted into the connector, a second portion whereby the element can be mounted in opposed spaced relationship to the opposite element on an insulating mount and a third, leaf-spring, portion arranged to bear against and make electrical contact with the second portion of the opposite element, the first, second and third portions of each element being integrally formed, and the connector being characterized in that each element is asymmetrical and in that an end portion of each leaf-spring portion is wipable against a respective opposed second portion as the two opposed elements are urged apart by insertion of a circuit board therebetween and is separable from the opposed second portion by further insertion of the board to make contact with said conductive traces.

The invention also provides an electrically-conductive element suitable for use with a like element to provide a connector clip for electrical attachment to a circuit board, the element comprising a mounting portion, an arched portion and a leaf-spring portion integrally formed of a resiliently flexible material, the element being characterized in that the element is asymmetrical and further comprises an integrally-formed curved leaf-spring portion located so that when the element is mounted in proper spaced face-to-face relationship relative to a like element, the leaf-spring portion of each element is in opposed relationship to the arched portion and the curved portion of the other with an end portion of each leaf-spring portion urged against the curved portion of the other, such that a circuit board can be inserted between the two elements to urge the arched portions apart while maintaining electrical contact therewith and such that the circuit board can be further inserted between the two elements to urge the leaf-spring portions apart while maintaining electrical contact therewith, the action of the end portion being to wipe against the opposed curved portions to clean the contacting surfaces thereof as the element is flexed during insertion or withdrawal of the circuit board.

The invention also provides an electrically-conductive connector element suitable for use with a like element to provide a connector clip for electrical attachment to a circuit board, the element being formed of a resiliently flexible material and comprising first and second elongate portions and an arched portion, the elongate portions being integrally joined in side-by-side relationship, the first elongate portion providing a leaf-spring and the second elongate portion being integrally formed with a mounting portion, the free end portion of the leaf-spring, and the arched portion being arranged to bear against electrical contacts of a circuit board so that electrical contact is made between the connector and the circuit board, and electrical contact is maintained between the two elements until the circuit board is fully inserted into the connector, the element being characterized in that, when it is used in face-to-face relationship with a like element, the end portion of each leaf-spring has a wiping, self-cleaning action against the second elongate portion of the other element, when the elements are flexed by insertion therebetween and/or removal therefrom of a circuit board.

There now follows a detailed description which is to be read with reference to FIGS. 6 to 12 of the accompanying drawings of an element and connector according to the invention; it is to be clearly understood that the element and the connector have been selected for description to illustrate the invention by way of example and not by way of limitation.

FIG. 6 is a perspective view of an element according to the invention;

FIG. 7 is a side view of a connector according to the invention in a first, relaxed, condition;

FIG. 8 is a side view of the connector of FIG. 6 partially extended by an edge portions of a printed circuit board;

FIGS. 9 and 10 are exaggerated views illustrating a characteristic feature of the present invention:

FIG. 11 is a side view, similar to FIG. 8, of the connector, showing the connector in fully expanded condition with a printed circuit board inserted therein; and FIG. 12 is a perspective view of a further element according to the invention.

The element shown in FIG. 6 is formed of metal or metal-coated plastics material, which is resiliently flexible. It comprises two elongate portions indicated generally at 600 and 610 which are integral with a bridge portion 620. The elongate portion 600 comprises a first, arched, portion 630, a second flat spacer portion 640, a further, arched, portion 650 and a planar, mounting portion 660. In the relaxed condition shown in FIG. 6, the bridge portion 620 and the mounting portion 660 are coplanar. The arched portion 630 is more pronounced than the arched portion 650.

The elongate portion 610 is formed as a curved leaf spring curving from the bridge portion 620 in the same direction as the arched portions 630, 650 away from the plane defined by the portions 620 and 660. The leaf-spring portion 610 terminates as a shoe portion 670 and is of a length such that, if bent flat, the shoe portion would lie adjacent the lower portion of the arched portion 650.

In use, the element shown in FIG. 6 is mounted on a base 680 in face-to-face, opposed relationship with a like element to provide a connector as shown in FIG. 7, with the mounting portions also providing terminal pads for connection of the circuit board connected in a transmission line. The two elements provide the jaws 104, 106 of the spring clip 102 shown in FIG. 1.

Figure 3A:
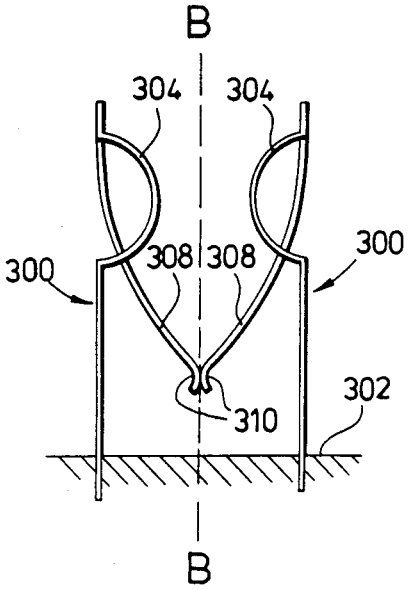
Figure 3B:
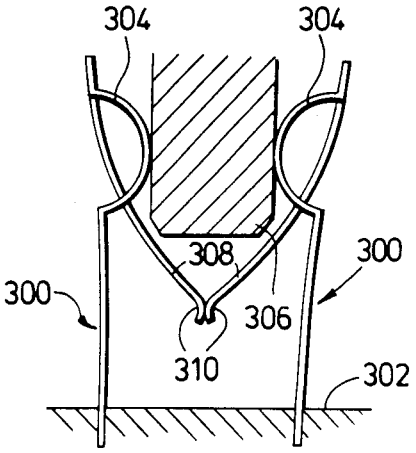
Figure 3C:
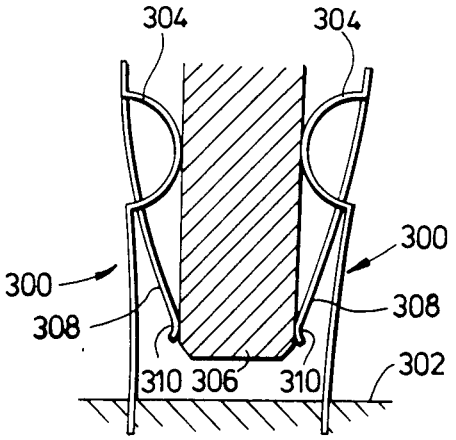

The two elements are so mounted that the elongate portion 600, 600' of each is in face-to-face relationship with the leaf-spring portion 610', 610 respectively of the other, and the separation of the mounting portions 660, 660' is such that the shoe portion 670, 670' of each bears positively against the curved, arched portion 650', 650 of the other so that electrical contact is achieved therebetween, providing two contact areas as opposed to the single contact area achieved by the prior art (see FIG. 3*a*). The distance of separation of the arched portions 630, 630' is less than the thickness of a printed circuit board to be inserted therebetween.

The edge portion of a printed circuit board 690 is inserted between the two elements and forces them to flex or bend outwardly as the arched portions 630, 630' are urged apart. This movement of separation causes the shoe portion 670, 670' of each element to slide along the surface of each shallower arched portion 650', 650 respectively, in the direction of the arrow C shown in FIG. 8. In the illustrated construction, the movement of separation of the arched portions 630, 630' is substantially arcuate, and is the result of flexing of the curved portions 650, 650' about the junction of these portions with the mounting portions 660, 660' of the portions 640, 640' and of movement of the arched portions 630, 630' relative to the portions 640, 640'. Thus, as the upper extremities, viewing FIG. 8, of the arched portions 630, 630' move apart, the shoe portions of the leaf-spring portions will follow the movement and be drawn along the surfaces of the curved portions, due to the change in attitude of the leaf-spring portions.

The effective movement of the shoe portions 670, 670' along the surfaces is shown by the illustration in exaggerated form in FIGS. 9 and 10 of the movement of the shoe portion 670 against the curved portion 650', FIG. 9 showing the relationship when the connector is in its relaxed state (that of FIG. 6) and FIG. 10 showing the relationship when the elements of the connector are urged apart as in FIG. 7. Between these two positions, each shoe portion will effect a sliding, scraping motion against the curved portion while changing its attitude so as to effect a self-wiping action between mutually self-contacting portions of the shoe portion and the surface of the curved portion.

As the edge portion of the printed circuit board is urged between the arched portions 630, 630', the arched portions make electrical contact with electrically-conductive traces on the board whilst the shoe portions maintain contact with the curved portions 650', 650 respectively. Continuity of circuit is thus maintained through both the leaf-spring portions contacting the opposed elements and the normally-closed contact of the relay on the board which is equivalent to the relay RL1 of FIG. 1.

When the edge portion of the board is urged further into engagement with the spring clip connector, as shown in FIG. 11, the leaf-spring portions 610, 610' are themselves sprung apart and make electrical contact with the traces on each side of the board, so that continuity of the circuit is transferred to the circuit board, specifically through the relay RL1.

The self-wiping facility of the elements of the connector is of great significance when, for whatever reason, it is desired to withdraw the board from the connector, e.g., to replace a defective relay. At this stage it is critical that, when the board is partially withdrawn from the FIG. 11 position to the FIG. 8 position, the leaf-spring portions 610, 610' make good electrical contact with the opposite curved portions 650', 650 respectively for otherwise, when the circuit board is fully withdrawn from the connector, the circuit will be broken.

As will be seen by reference again to FIGS. 9 and 10, aggregation of dirt or corrosion can be removed by the scraping motion of the shoe portions 670, 670' of each leaf-spring portion along the surface of the curved portion, as the shoe portion moves from the position shown in FIG. 10, which is the position adopted immediately the leaf-spring portions have been released from engagement with the printed circuit board, to the position shown in FIG. 9.

An alternate embodiment of an element according to the invention is shown in FIG. 12 where the arched portion of the previous embodiment itself provides a bridge portion 700 between an elongate mounting portion 710 and leaf-spring portion 720. In this embodiment, no curved portion, corresponding to the curved portion 650 shown in FIG. 6, is provided, although it may be if desired.

It is believed that the curvature of the curved portion of each element provides for a more variable geometry thus allowing for a larger surface area of each shoe portion to be cleaned. Obviously, the geometry of the portions of the individual elements can be varied according to requirements.

What is considered to be important, however, is the asymmetry of the individual elements whereby a sliding movement of contacting portions of the opposed elements can be obtained.

I claim:

1. An electrically-conductive connector element suitable for use with a like element, when mounted in face-to-face relationship therewith, in providing a connector for electrical connection to a printed circuit board, the element comprising a bridge portion (620) and first and second resiliently-flexible elongate portions (610,600) in side-by-side relationship and integrally-formed with said bridge portion, the first elongate portion being formed as a leaf-spring (610) to electrically contact the opposed element, and the element further comprising a laterally-extending portion (630) arranged to face the other element so that a printed circuit board can be inserted between the two elements firstly to conductively engage the laterally-extending portions with conductive traces on opposite sides of the circuit board and urge them apart while electrical contact is maintained between the two elements, and so that the circuit board can be further inserted to separate the leaf-springs (610) from electrical contact with the opposed element and to establish electrical contact between the leaf-springs and said conductive traces, the element being characterized in that the second elongate portion (600) thereof comprises a mounting portion (600), and the leaf-spring (610) is of a length and shape such that as the laterally-extending portions (630) of the two elements of a connector are urged apart of flex together, the end portion (670) of each leaf-spring wipes against surface portions of the opposed element to provide selfcleaning of the contacting surface.

2. An element according to claim 1 characterized in that the second elongate portion (600) includes said laterally-extending portion (630), said laterally-extending portion being provided adjacent the bridge portion (620).

3. An element according to claim 1 characterized in that the laterally-extending portion is provided by the bridge portion.

4. An element according to claim 1 characterized in that the leaf-spring (610) thereof is adapted, when the element is mounted in opposed relationship to a like element, to electrically contact the second elongate portion (600) of the like element, whereby two separate electrical connections are made between the elements.

5. An element according to claim 4 characterized in that the second elongate portion (600) also comprises a curved portion (650) bowed in the same direction as the laterally-extending portion (630) and provided between the laterally-extending portion and the mounting portion (660).

6. An element according to claim 5 characterized in that the end portion of the leaf-spring (610) is adapted to bear against the curved portion (650) of an opposed element.

7. A connector for electrical attachment to a printed circuit board and comprising a pair of electrically-conductive resiliently-flexible elements arranged to be mounted in face-to-face relationship, each element comprising a bridge portion (620) and first and second elongate portions (610, 600) in side-by-side relationship and integrally-formed with said bridge portion, the first elongate portion being formed as a leaf-spring (610) arranged to electrically contact the opposed element, and each element further comprising a laterally-extending portion (630) facing the other element so that a printed circuit board can be inserted between the two elements firstly to conductively engage the laterally-extending portions with conductive traces on opposite sides of the circuit board and urge them apart while electrical contact is maintained between the two elements, and so that the circuit board can be further inserted to separate the leaf-springs (610) from electrical contact with the opposed element and to establish electrical contact between the leaf-springs and said conductive traces, the connector being characterized in that each second elongate portion (600) comprises a mounting portion (660), and each leaf-spring (610) is of a length and shape such that as the laterally-extending portions (630) are urged apart or flex together, the end portion (670) of each leaf-spring wipes against surface portions of the opposed element to provide self-cleaning of the contacting surfaces.

8. Means for connecting circuit means to components on a printed circuit board, said means comprising a plurality of connectors as set forth in claim 7 and arranged in a linear array for receiving and making electrical contact with conductive traces provided along an edge portion of the circuit board and electrically connected with said components.

* * * * *